US011723441B1

(12) United States Patent
Landers et al.

(10) Patent No.: US 11,723,441 B1
(45) Date of Patent: Aug. 15, 2023

(54) ADVANCED SEALING-INTERFACE SURVEILLANCE TECHNOLOGY

(71) Applicant: U.S. Army Combat Capabilities Development Command, Chemical Biological Center, Apg, MD (US)

(72) Inventors: John M Landers, Riverton, NJ (US); Cody C Kendig, Jarretsville, MD (US); Anne Y Walker, Baltimore, MD (US); Daniel J Barker, Red Lion, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/722,079

(22) Filed: Apr. 15, 2022

(51) Int. Cl.
*A44B 19/26* (2006.01)

(52) U.S. Cl.
CPC ..... *A44B 19/262* (2013.01)

(58) Field of Classification Search
CPC ..... A44B 19/262; H01H 2001/125
See application file for complete search history.

(56) References Cited

U.S. PATENT DOCUMENTS 4,603,327 A * 7/1986 Leonard ..... G08B 21/00 455/100
4,755,802 A * 7/1988 Urbanczyk ..... A45C 13/24 116/84
4,829,603 A * 5/1989 Schnoor ..... A47G 25/902 2/84
6,029,482 A * 2/2000 Rifkin ..... A44B 19/301 109/43
7,971,279 B2 * 7/2011 Abanto ..... A44B 19/26 2/218
8,533,918 B1 * 9/2013 Ketter ..... A44B 19/301 24/429
10,076,163 B2 * 9/2018 Umekawa ..... A44B 19/24
10,192,421 B2 * 1/2019 Tourrette ..... A44B 1/02
10,403,450 B2 * 9/2019 Tourrette ..... A44B 19/24
10,584,980 B2 * 3/2020 Ballantyne ..... G01D 5/14
10,716,341 B2 * 7/2020 Maxey ..... A41D 13/0051
10,835,002 B2 * 11/2020 Umekawa ..... A44B 19/42
2008/0252461 A1 * 10/2008 Sugata ..... G06K 19/04 340/572.1
2010/0038276 A1 * 2/2010 Chen ..... A45C 13/02 24/399

(Continued)

*Primary Examiner* — Robert Sandy
*Assistant Examiner* — Louis A Mercado
(74) *Attorney, Agent, or Firm* — Ulysses John Biffoni

(57) ABSTRACT

A material closure assembly including a material closure, such as zipper or a hook and loop fastener, having a first portion and a second portion that are configured to be releasably joined together; an electrical circuit that is configured to be closed when the first portion of the material closure is entirely joined with the second portion of the material closure; and an first indicator that is electrically connected to the electrical circuit and configured to indicate that the first portion of the material closure is entirely joined with the second portion of the material closure. The material closure assembly thus providing an active feedback system for closures on garments and personal protective equipment (PPE) to alert wearer of incomplete seals between interfaces on modular PPE which could result in the wearer of the PPE being exposed to the surrounding environment outside the PPE.

14 Claims, 2 Drawing Sheets

(56) References Cited

U.S. PATENT DOCUMENTS

| | | | | |
|---|---|---|---|---|
| 2015/0287561 | A1* | 10/2015 | Levesque | H01F 7/0273 190/100 |
| 2021/0289892 | A1* | 9/2021 | Tourrette | A44B 19/34 |

* cited by examiner

ADVANCED SEALING-INTERFACE SURVEILLANCE TECHNOLOGY

GOVERNMENT INTEREST

The invention described herein may be manufactured, used, and/or licensed by or for the United States Government.

FIELD OF THE INVENTION

The present invention relates to an active feedback system for closures on garments and personal protective equipment (PPE), and in particular to a feedback system designed to alert users of incomplete seals between interfaces on PPE which could result in the wearer of the PPE being exposed to the surrounding environment outside the PPE.

BACKGROUND OF THE INVENTION

Personal protective equipment (PPE) is worn by chemical, biological, radiological and nuclear (CBRN) defense personnel and others to protect such personnel from exposure to dangerous environments that may contain toxic chemicals that include, but are not limited to, chemical warfare agents (CWA), biological warfare agents (BWA), radiation, toxic industrial chemicals (TIC), and so on. Many of these toxic chemicals present a lethal threat upon exposure. These chemicals can be dispensed either through a gaseous, vapor or liquid form, and contaminate surfaces upon contact. Lethality can occur through different pathways and may include inhalation or being absorbed through the skin. Chemical warfare agents may include bis (2-chloroethyl)sulfide, also known as HD or mustard gas, which is a powerful vesicant chemical warfare agent (CWA) that causes large blisters on the exposed skin, eyes, and lungs. Pinacolyl methylphosphonofluoridate, which is also known as Soman or GD, and O-ethyl S-(2-diisopropylamino)ethyl methylphosphonothiolate, known as VX; are nerve agents that represents a class of organophosphorus compounds (OPs) that inhibit acetylcholinesterase (AChE). The inhibition of AChE causes neuromuscular paralysis, which if left untreated can lead to death within minutes of exposure. Despite its international ban, CWAs continue to be a deployed in combat areas and in terrorist attacks. In additional to uses against chemical warfare agents, their simulants and toxic industrial chemicals, PPE is often utilized to provide protection against biological entities. These may represent bacteria, microbial, and viruses. Protection can also be provided against radioactive or nuclear hazards.

Existing PPE includes, but is not limited to, suits that fully enclose and serve as a barrier to the environment external to the suit. Traditionally, this has included one-piece suits that lack any modular features and may include a single zipper for enclosure. However, with the continued modernization of CBRN defenses there is a need to advance beyond burdensome one-piece suits towards lighter-weight, modular suits. However, a significant challenge resulting from the modular framework of these suits is interfacial failure points where contaminants can infiltrate. Interfaces are defined as a portion of a PPE, such as a garment or a suit, that requires two entities of the PPE to come together and be properly sealed (e.g. glove-wrist and hood-mask). Examples of sealed interfaces include zippers or a hook and loop fastener (such as Velcro) flap. However, when these interfaces are not completely sealed, that is the zipper is not fully closed or the hook and loop fastener is not completely connected, then the wearer of the PPE is at an increased risk of exposure to the surrounding environment outside of the PPE. The sealing surface at these interfaces can also be disrupted due to user movements, particularly when wearing additional equipment that creates unintended anchor points in the suit. Furthermore, wearer movement can create a bellow effect, where the surrounding vapor is pulled into an improperly sealed suit. Additionally, some simple seal failures such as an unzipped zipper or an improperly donned mask, can be observed only via a 'Buddy Check' system, whereby the enclosures are verified by a person that is not the wearer.

While advances have been made in the field of zippers, there is still a significant need for ensuring such closures at interfaces are properly sealed, especially in the context of PPE. For example, there have been in recent years patent applications on automatic zippers (U.S. Pat. No. 8,533,918B1, U.S. Pat. No. 7,971,279B2). However, these examples were designed to primarily help persons having arthritic ailments who have trouble manually closing the zipper. Additionally, advances in zipper technology include examples of a zipper that when fully closed is connected to circuit (US 2010/0038276 A1) for handbags and aprons where the requirement for complete sealed closure is much lower as compared to PPE.

Thus, there exists a need for a system that ensures that these interfaces on PPE are properly sealed and that alerts a wearer to incomplete seals in PPE.

SUMMARY OF THE INVENTION

The present disclosure provides an inventive material closure assembly having an active feedback system for indicating proper closure of a garment or piece of equipment that requires complete, sealed closure due to the possible presence of toxic substances in the surrounding environment external to the equipment in order to protect a wearer or user thereof. The material closure assembly includes a material closure having a first portion and a second portion that are configured to be releasably joined together; an electrical circuit that is configured to be closed when the first portion of the material closure is entirely joined with the second portion of the material closure; and an first indicator that is electrically connected to the electrical circuit and configured to indicate that the first portion of the material closure is entirely joined with the second portion of the material closure. According to embodiments, the material closure is a zipper or a hook and loop fastener. The present invention thus provides an active feedback system for closures on garments and personal protective equipment (PPE) to alert wearer of incomplete seals between interfaces on modular PPE which could result in the wearer of the PPE being exposed to the surrounding environment outside the PPE.

BRIEF DESCRIPTION OF THE DRAWINGS

The present invention is further detailed with respect to the following figures that depict various aspects of the present invention.

DETAILED DESCRIPTION OF THE PREFERRED EMBODIMENTS

Figure 1A:
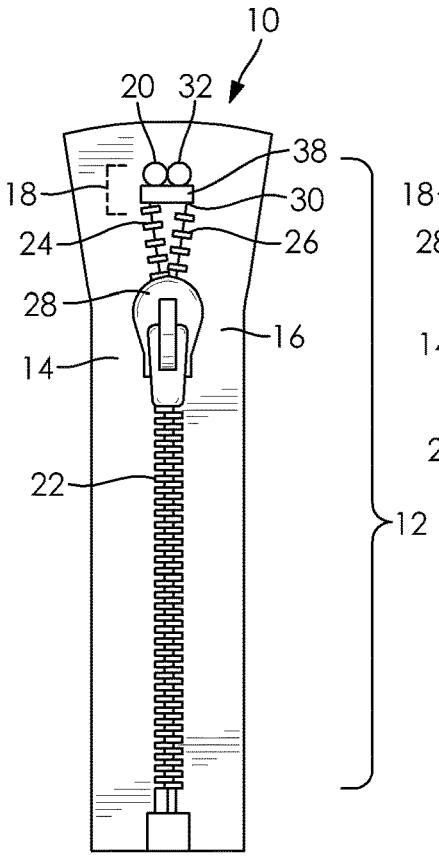
FIG. 1A is a schematic drawing of a material closure assembly according to embodiments of the present invention in a partially open configuration.

The present invention has utility as an active feedback system for closures on garments and personal protective equipment (PPE) to alert wearer of incomplete seals between interfaces on modular PPE which could result in the wearer of the PPE being exposed to the surrounding environment outside the PPE. Beyond PPE, it is also envisioned that these seals and active feedback system are applicable to personnel equipment such as gloves, shoes, tents, taurpaulins, filter masks, flaps on vehicles, and any other equipment where the requirement for complete, sealed closure is high due to the possible presence of toxic substances in the surrounding environment external to the equipment.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below. As used in the description of the invention and the appended claims, the singular forms "a," "an" and "the" are intended to include the plural forms as well, unless the context clearly indicates otherwise. Also as used herein, "and/or" refers to and encompasses any and all possible combinations of one or more of the associated listed items, as well as the lack of combinations when interpreted in the alternative ("or").

Figure 1B:
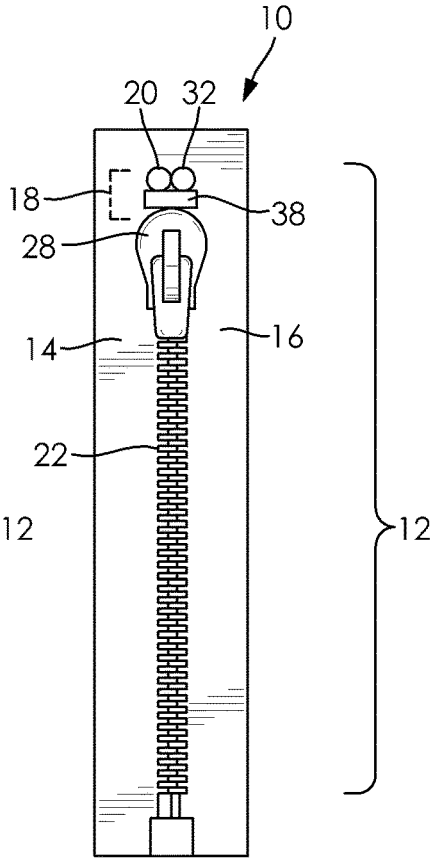
FIG. 1B is a schematic drawing of a material closure assembly according to embodiments of the present invention in a closed configuration.
Figure 2:
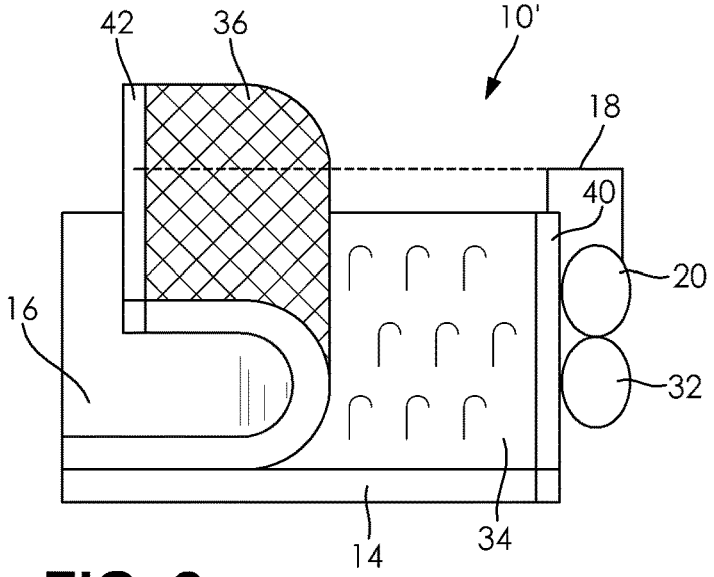
FIG. 2 is a schematic drawing of a material closure assembly according to embodiments of the present invention in a partially open configuration.

Referring now to the drawings, a material closure assembly 10, 10' having an active feedback system for indicating proper closure is shown generally in FIGS. 1A, 1B, and 2 according to various embodiments of the present invention. According to embodiments, an inventive material closure assembly 10, 10' includes a material closure 12, an electrical circuit 18, and an indicator 20. Generally, the material closure 12 includes a first portion 14 and a second portion 16 that are configured to be releasably joined together. That is, when the first portion 14 and second portion 16 are disengaged from one another, the material closure 12 is in an open configuration as shown in FIG. 1A, and when the first portion 14 and second portion 16 are engaged with one another, the material closure 12 is in a closed configuration as shown in FIG. 1B.

The material closure 12 is part of the electrical circuit 18. According to embodiments, the electrical circuit 18 is a fault detection circuit. The electrical circuit 18 is configured to be open, or incomplete, when the material closure 12 is in the open configuration, i.e. when the first portion 14 and the second portion 16 are not entirely and properly joined together. On the other hand, the electrical circuit 18 is configured to be closed, or complete, when the material closure 12 is in the closed configuration, i.e. when the first portion 14 and the second portion 16 are entirely and properly joined together in a sealed, closed fashion. According to embodiments, the electrical circuit 18 is formed of electrical wires, resistors, capacitors, circuit boards, or a combination thereof. According to further embodiments, the electrical circuit 18 is formed of patterns of conductive inks or pastes. These inks or pastes can be comprised of different conductive entities, such as activated carbons, graphene, carbon nanotubes, metal particles, or a combination thereof. These conductive entities may be dispersed in a solution to form an ink or a more viscous paste with the aid of surfactants or polymers. Methods to apply the conductive pattern may include but are not limited to inkjet printing, screen printing and solution deposition. According to embodiments, the electrical circuit 18 is formed with a conductive pattern by the use of an electroless metal deposition method. This approach typically involves the use of first a laser cutter to form a pattern on the material of interest prior to the electroless metal deposition. The material of interest may represent a 3D printed plastic material (i.e. PLA) or current material employed in PPE garments. The use of a laser cutter in creating the pattern produces microscale roughness, by which a catalyst can be deposited. In one embodiment the catalyst deposited on the laser cut pattern may include a combination of a palladium salts and tin salts in different molar ratios. The deposition of this catalyst is then followed by the deposition of the metal for the formation of the circuit. In one embodiment this may include the use of a copper salt that is subsequently reduced to form a copper thin film.

The indicator 20 is electrically connected to the electrical circuit 18 and is configured to indicate that the first portion 14 of the material closure 12 is entirely joined with the second portion 16 of the material closure 12. That is, when the first portion 14 of the material closure 12 is properly and entirely joined with the second portion 16 of the material closure 12 in a sealed, closed fashion, the indicator 20 provides feedback to a user or wearer of the material or garment that the material closure 12 is properly and totally in the closed configuration. According to embodiments, the indicator 20 is a light emitting diode (LED), a speaker, or a display indicator that may appear on a heads-up display associated with the garment with which the material closure assembly 10, 10' is used. According to embodiments, the material closure assembly 10, 10' additionally includes a second indicator 32 electrically connected to the electrical circuit 18 that is configured to indicate that the first portion 14 of the material closure 12 is not entirely joined with the second portion 16 of the material closure 16, that is, to indicate when the material closure 12 is in the open configuration and thus is not properly sealed, thereby allowing potential hazards from the external environment into the garment with which the material closure assembly 10, 10' is used. According to embodiments, the second indicator 32 is a light emitting diode (LED), a speaker, or a display indicator. According to embodiments, the second indicator 32 is a piezoelectric element such as a small electrical sound speaker connected to the circuit 18. In yet another embodiment the incomplete closure may be indicated by graphical icon that appears in a heads-up display.

As shown in FIGS. 1A and 1B, the material closure assembly 10 includes a material closure 12 that is a zipper. The zipper closure includes a zipper chain 22 formed of a first set of zipper teeth 24 and a second set of zipper teeth 26 as the first portion 14 and second portion 16 of the material closure 12, respectively. The zipper closure additionally includes a zipper slider 28 that is slidably mounted on the zipper chain 22 and is configured to releasably join the first set zipper teeth 24 to the second set of zipper teeth 26 as the zipper slider is moved along the zipper chain 22. According to embodiments, the electrical circuit 18 is closed, and thus the indicator 20 is activated, when the zipper slider 28 is positioned at a first end 30 of the zipper chain 22 when the first set zipper teeth 24 are joined to the second set of zipper teeth 26. According to embodiments, contact between the zipper slider 28 and a zipper stop 38 positioned at the first end 30 of the zipper chain 22 is what closes the electrical circuit 18, thus activating the indicator 20, such that for example the LED turns on as an indication that the zipper closure is properly and totally closed in a sealed fashion. According to embodiments, it is also contemplated that the indicator 20 could instead be activated when the circuit 18 is open, that is, when the zipper is in the open configuration. Alternatively, a second indicator 32 may be employed that is activated when the circuit 18 is open to alert the wearer that the closure is not properly sealed.

As shown in FIG. 2, the material closure assembly 10' includes a material closure 12 that is a hook and loop closure. The hook and loop closure includes a hook portion 34 and a loop portion 36 as the first portion 14 and second portion 16 of the material closure 12, respectively. According to embodiments, the electrical circuit 18 is closed, and thus the indicator 20 is activated, when the hook portion 34 is fully in contact with the loop portion 36. According to embodiments, the full contact between the hook portion 34 and the loop portion 36 is indicated by contact between a hook portion electrical contact 40 and a loop portion electrical contact 42 that are positioned at a far end of the hook and loop closure or alternatively that surround each portion of the hook and loop closure. Accordingly, when the hook portion electrical contact 40 and the loop portion electrical contact 42 are in contact, the electrical circuit 18 is closed and thus activate the indicator 20. According to embodiments, it is also contemplated that the indicator 20 could instead be activated when the circuit 18 is open, that is, when the hook and loop closure is in the open configuration. Alternatively, a second indicator 32 may be employed that is activated when the circuit 18 is open to alert the wearer that the closure is not properly sealed.

Figure 3:
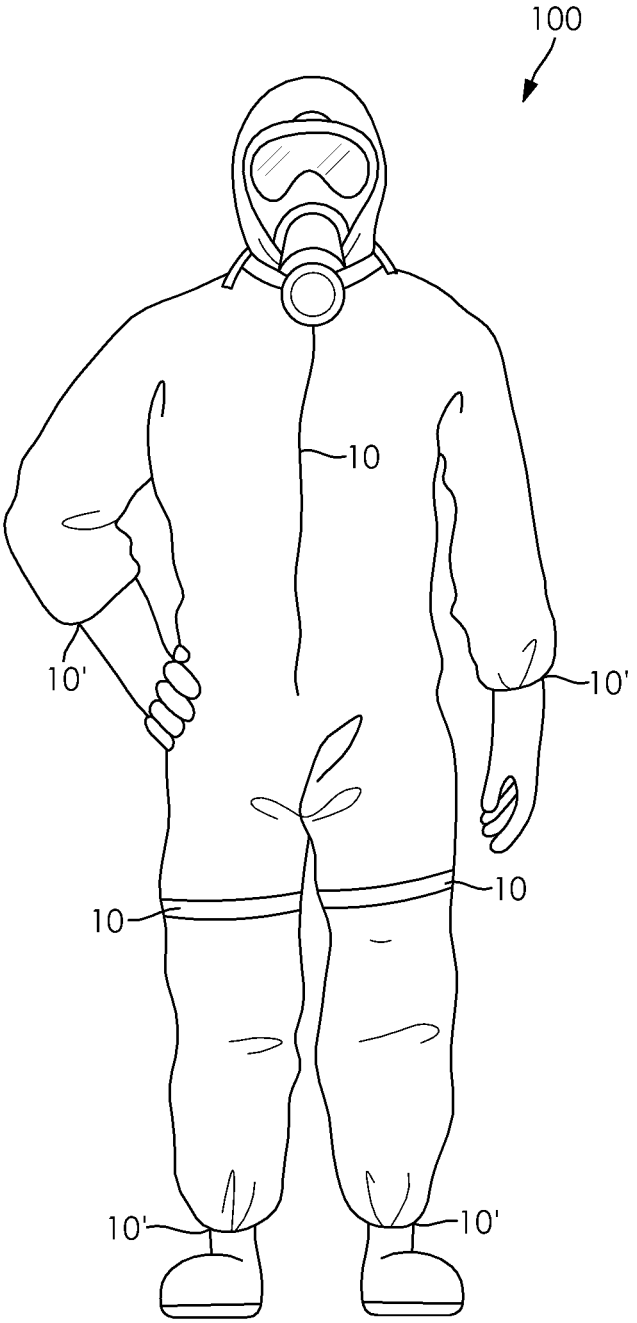
FIG. 3 is a schematic drawing of personal protective equipment (PPE) utilizing material closure assemblies according to embodiments of the present invention.

As shown in FIG. 3, the material closure assembly 10, 10' is used for joining portions of personal protective equipment (PPE) 100, such as a modular PPE suit. Accordingly, the material closure assembly 10, 10' provides an active feedback system for closures on garments and PPE to alert a wearer of incomplete seals between interfaces on modular PPE which could result in the wearer of the PPE being exposed to the surrounding environment outside the PPE. Beyond PPE, it is also envisioned that these seals and active feedback system are applicable to personnel equipment such as jackets, gloves, boots, shoes, pants, tents, tarpaulins, filter masks, flaps on vehicles, sports equipment, and any other equipment where the requirement for complete, sealed closure is high due to the possible presence of toxic substances in the surrounding environment external to the equipment.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention but is not meant to be a limitation upon the practice thereof. The following claims, including all equivalents thereof, are intended to define the scope of the invention.

The invention claimed is:

1. A material closure assembly having an active feedback system for indicating proper closure, comprising:

a material closure comprising a first portion and a second portion, the first portion and the second portion of the material closure configured to be releasably joined together;

an electrical circuit that is configured to be closed when the first portion of the material closure is entirely joined with the second portion of the material closure;

a first indicator electrically connected to the electrical circuit and configured to indicate that the first portion of the material closure is entirely joined with the second portion of the material closure; and a second indicator electrically connected to the electrical circuit and configured to indicate that the first portion of the material closure is not entirely joined with the second portion of the material closure.

2. The material closure assembly of claim 1, wherein the material closure is a zipper comprising a zipper chain, the first portion is a first set of zipper teeth, and the second portion is a second set of zipper teeth.

3. The material closure assembly of claim 2, wherein the zipper further comprises a zipper slider slidably mounted on the zipper chain and configured to releasably join the first set zipper teeth to the second set of zipper teeth.

4. The material closure assembly of claim 3, wherein the electrical circuit is closed when the zipper slider is positioned at a first end of the zipper chain when the first set zipper teeth are joined to the second set of zipper teeth.

5. The material closure assembly of claim 1, wherein the material closure is a hook and loop closure, wherein the first portion is a hook portion and the second portion is a loop portion.

6. The material closure assembly of claim 5, wherein the electrical circuit is closed when the hook portion and the loop portion are entirely joined together.

7. The material closure assembly of claim 1, wherein the electrical circuit is a fault detection circuit.

8. The material closure assembly of claim 1, wherein the electrical circuit is formed of electrical wires, resistors, capacitors, circuit boards, or a combination thereof.

9. The material closure assembly of claim 1, wherein the electrical circuit is formed of at least one conductive ink or paste.

10. The material closure assembly of claim 9, wherein the at least one conductive ink or paste comprises activated carbons, graphene, carbon nanotubes, metal particles, or a combination thereof.

11. The material closure assembly of claim 9, wherein the at least one conductive ink or paste comprises conductive elements dispersed in a solution of surfactants or polymers.

12. The material closure assembly of claim 1, wherein the first indicator is a light emitting diode (LED), a speaker, or a display indicator.

13. The material closure assembly of claim 1, wherein the second indicator is a light emitting diode (LED), a speaker, or a display indicator.

14. The material closure assembly of claim 1, wherein the material closure is configured to releasably join portions of personal protective equipment, sports equipment, jackets, gloves, boots, pants, shoes, tents, tarpaulins, filter masks, flaps on vehicles, or a combination thereof.

* * * * *